US005989079A

United States Patent [19]

Seko et al.

[11] Patent Number: 5,989,079

[45] Date of Patent: Nov. 23, 1999

[54] MALE SIDE TERMINAL FITTING

[75] Inventors: Satomi Seko; Masamitsu Chishima, both of Yokkaichi, Japan

[73] Assignee: Sumitomo Wiring System, Ltd., Japan

[21] Appl. No.: 08/898,864

[22] Filed: Jul. 23, 1997

[30] Foreign Application Priority Data

Jul. 26, 1996 [JP] Japan ..... 8-197943

[51] Int. Cl.[6] ..... H01R 13/04

[52] U.S. Cl. ..... 439/884; 439/745

[58] Field of Search ..... 439/884, 745

[56] References Cited

U.S. PATENT DOCUMENTS

| | | | |
|---|---|---|---|
| 4,767,357 | 8/1988 | Hasircoglu | 439/499 |
| 4,992,064 | 2/1991 | Steinhardt | 439/884 |
| 5,083,944 | 1/1992 | Pitts | 439/884 |
| 5,162,004 | 11/1992 | Kuzuno et al. | 439/845 |
| 5,344,336 | 9/1994 | Sampson | 439/397 |
| 5,475,922 | 12/1995 | Tamura et al. | 29/881 |

FOREIGN PATENT DOCUMENTS 0 572 874 12/1993 European Pat. Off. .

*Primary Examiner*—Neil Abrams
*Attorney, Agent, or Firm*—Banner & Witcoff, Ltd.

[57] ABSTRACT

A male terminal fitting 20 is formed by bending, for example, copper alloy metal plate, and comprises, in a unified manner, a barrel member 30, a contact protrusion 40 for insertion into a female terminal fitting, and a tubular member 50 located between these. The terminal fitting comprises an overlapping plate 53 that overlaps with a roof wall 52 of the tubular member 50, a strengthening plate 54 extending in a unified manner from the anterior end of the overlapping plate 53 entering into the root portion of the contact protrusion 40. As a result, the strength of the contact protrusion 40 is increased and change of shape thereof due to an external force is prevented.

9 Claims, 4 Drawing Sheets

MALE SIDE TERMINAL FITTING

TECHNICAL FIELD

The present invention relates to a male terminal fitting, particularly a fitting formed by bending electrically conducting metal plate, and having strengthened support.

BACKGROUND TO THE INVENTION

A male terminal fitting of a prior type is shown in FIG. 9. Such a male terminal fitting is formed by bending metal sheet of copper alloy or the like, and comprises, in a unified manner, a barrel member 1 for attachment of an electric wire (not shown), a contact protrusion 2 for insertion into a female terminal fitting (not shown), and an angular tubular member 3 located between the barrel member 1 and the contact protrusion 2. The angular tubular member 3 is formed by bending the sheet metal into a box shape and making both ends meet, and the contact protrusion 2 is formed by bending it into a cross-sectionally U-shaped groove. Since such a male terminal fitting is formed of sheet metal, it has the advantage of low production cost.

However, in a male terminal fitting with the above configuration, since the interior of the contact protrusion 2 is an empty groove, a strong external force may bend it about its root. In order to strengthen the contact protrusion, it has been proposed to include metal pins extending into the groove. However, in order to fix these pins a crimping or soldering step is required, resulting in an increase in cost.

The present invention has been developed after taking the above problem into consideration, and aims to present a male terminal fitting which permits low-cost production by allowing the male terminal fitting to be produced by bending sheet-metal, at the same time providing strengthening of the male terminal fitting.

SUMMARY OF THE INVENTION

According to the invention there is provided a male terminal fitting formed entirely of sheet metal, the terminal having a body and a contact protrusion extending therefrom, a strengthening member protruding also from said body and extending along the root of said contact protrusion. Preferably the contact protrusion is generally 'U' shaped at the root thereof, and the protruding strengthening member is in the 'U' shaped portion. In the preferred embodiment the strengthening member is wholly within the 'U' shaped portion, and is gripped resiliently by the walls thereof.

Such a strengthening arrangement has the substantial advantage that separate members are not required, and thus the terminal can be economically produced.

The terminal may further include an integral latching projection adapted to urge the strengthening member against the contact protrusion. In this way a strong self-supporting structure is obtained.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

A first embodiment of the present invention is explained hereinbelow, with reference to FIGS. 1 to 8.

Figure 1:
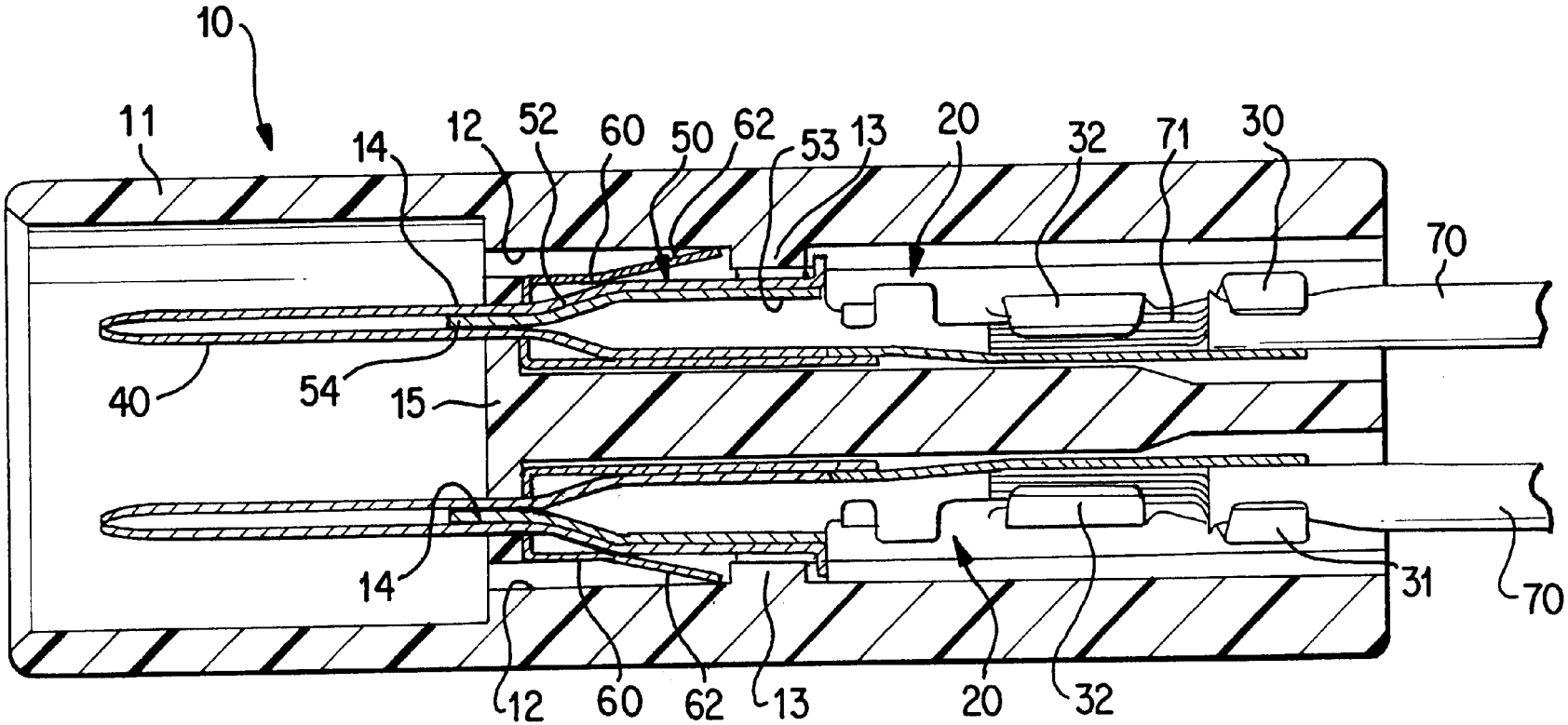
FIG. 1 is a transverse cross-sectional view showing a male terminal fitting of the present invention housed in a connector housing.

FIG. 1 shows male terminal fittings 20 according to the present invention within a connector housing 10. The connector-housing 10 has, for example, a hood 11, and cavities 12 which open into the hood 11 and which are formed at two levels, above and below. The cavities 12 have stopping protrusions 13 formed therein for stopping the male terminal fittings 20, a separating wall 15 being formed adjacent the hood 11 and having through holes 14.

The male terminal fitting 20 is formed by bending, for example sheet copper alloy, and comprises a barrel member 30 for attachment of an electric wire 70, a contact protrusion 40 for insertion into a female terminal fitting (not shown), and an angular tubular member 50 located between the barrel member 30 and the contact protrusion 40. The angular tubular member 50 has a protecting cover 60 attached thereon.

The protecting cover 60 is formed by bending into an angular tubular shape a material, for example stainless steel, that is stronger than the copper alloy with which the male terminal fitting 20 is made. When the protecting cover 60 is in a fitted state with the angular tubular member 50 of the male terminal fitting 20, stopping members 61 are bent, thereby fixing the protecting cover 60 to the male terminal fitting 20. The upper face of the protecting cover 60 has a lance 62 formed by shearing. When the male terminal fitting 20 is inserted into the cavity 12, the lance 62 fits with the stopping protrusion 13 of the connector housing 10, thereby fixing the male terminal fitting 20 inside the connector housing 10 in a conventional manner. At the side of the lance 62 is a projecting vertical wall 64 that extends in a unified manner from the protecting cover 60. Due to this, entry of an electric wire or the like into the bending space beneath the lance 62, and subsequent entanglement with and change of shape of the lance 62 are prevented. The lance may itself be strengthened by bent down edges, not shown, which also protect the bending space.

The contact protrusion 40 of the male terminal fitting 20 is formed so as to extend in a tapering and continuous manner from the anterior end of the tubular member 50, and forms a cross-sectionally U-shaped groove with one open side (see FIG. 8), its anterior end tapered.

Figure 3:
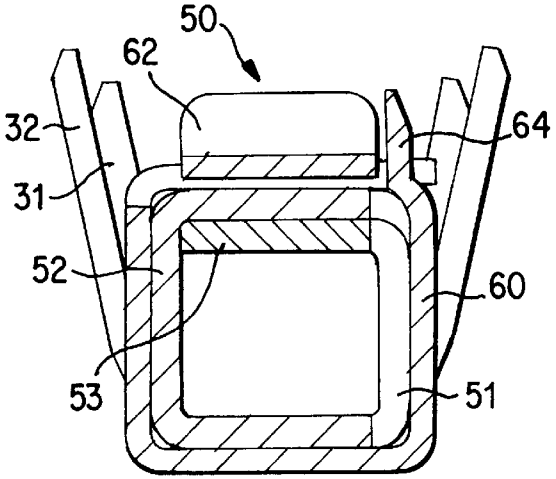
FIG. 3 is a transverse cross-sectional view of the male terminal fitting.
Figure 2:
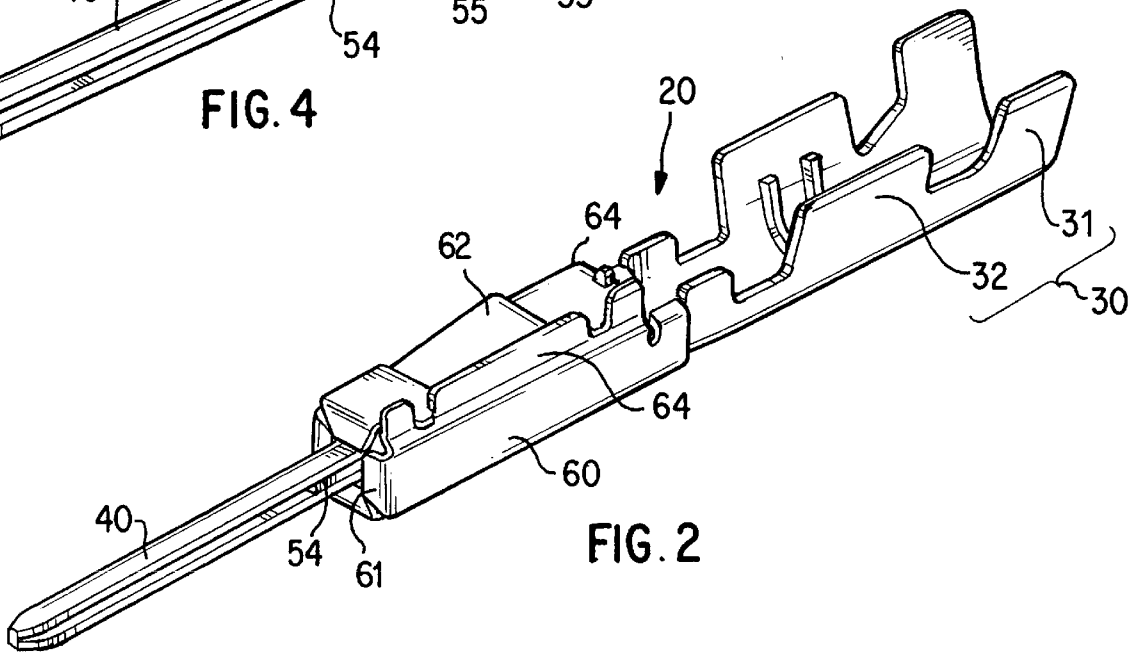
FIG. 2 is a diagonal view of the male terminal fitting of FIG. 1.
Figure 4:
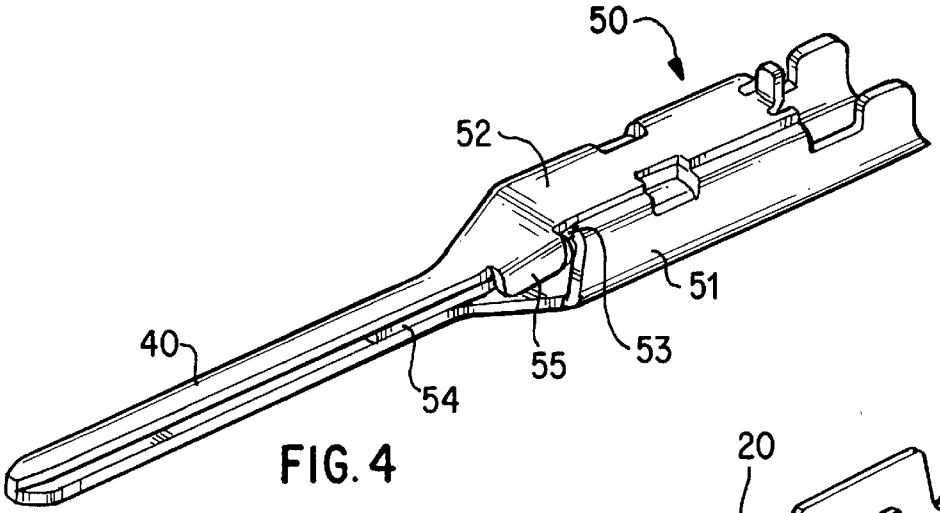
FIG. 4 is a diagonal view of a male terminal fitting with a protecting cover removed.
Figure 5:
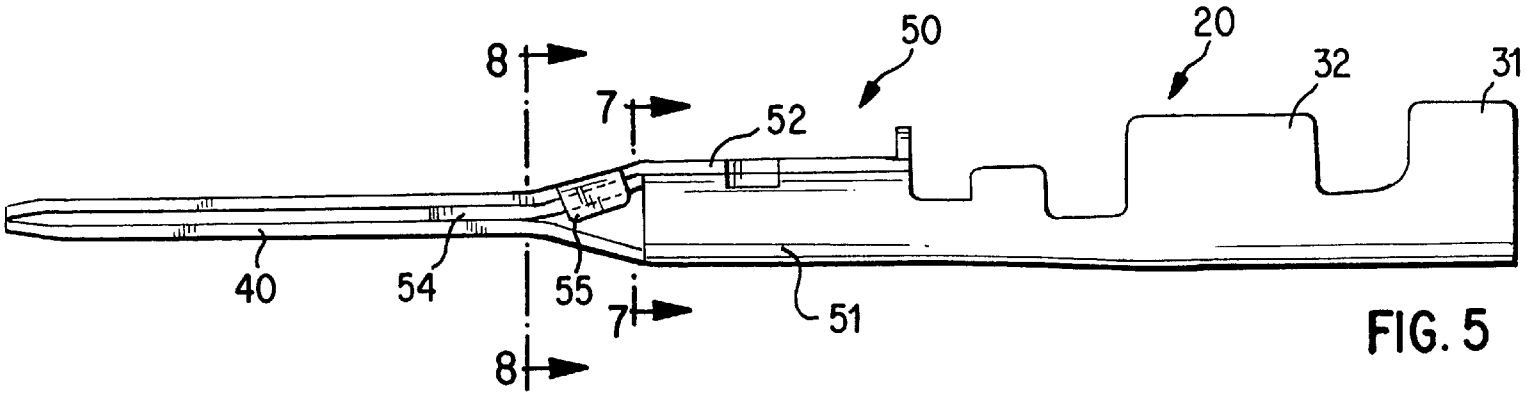
FIG. 5 is a side view of the male terminal fitting.
Figure 6:
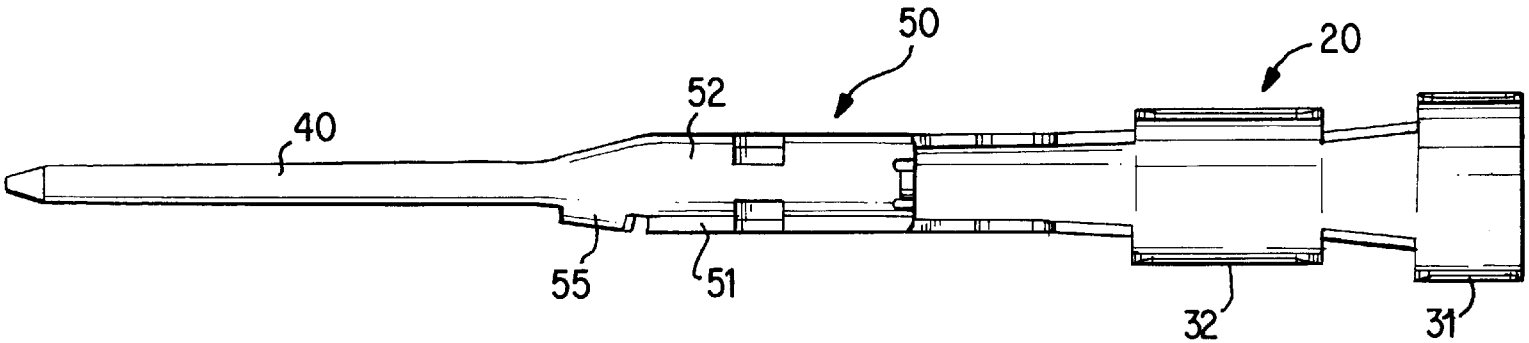
FIG. 6 is a plan view of the male terminal fitting.
Figure 9:
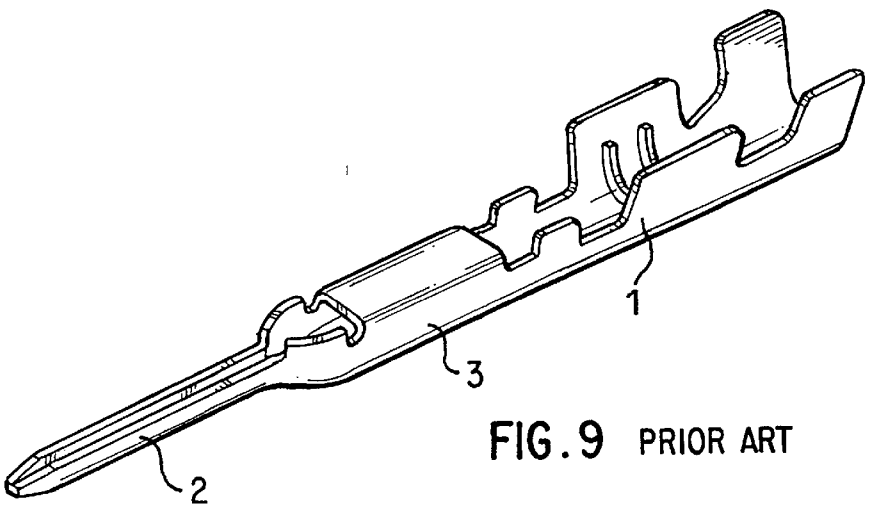
FIG. 9 PRIOR ART
FIG. 9 is a diagonal view of a prior art male terminal fitting.
Figure 7:
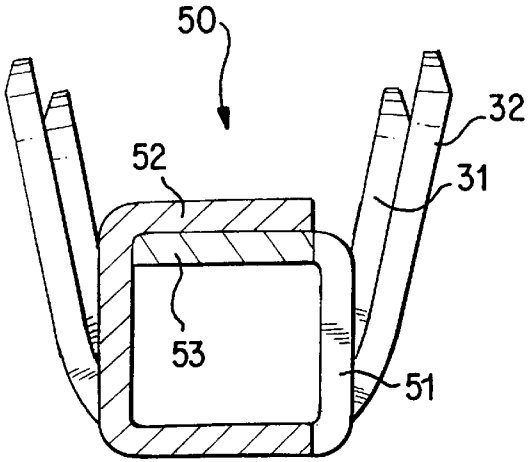
FIG. 7 is a vertical cross-sectional view of the male terminal fitting along the line 7—7 in FIG. 5.
Figure 8:
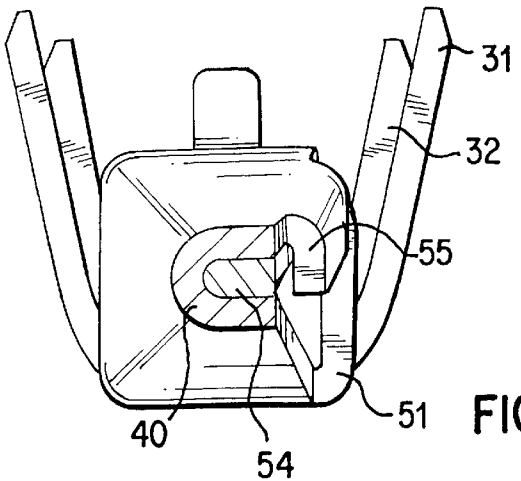
FIG. 8 is a vertical cross-sectional view of the male terminal fitting along the line 8—8 in FIG. 5.

As shown in FIG. 3 and FIG. 7, the angular tubular member 50 has an overlapping plate 53 that enters under a roof wall 52 from the upper edge of the right side wall 51, and from the anterior end of the overlapping plate 53 protrudes in a unified manner a strengthening plate 54 that enters into the root portion of the contact protrusion 40 (see FIG. 1). This strengthening plate 54 is unified with the contact protrusion 40 by being inserted into the root portion of the contact protrusion 40 as it is formed into the grooved shape by bending. The strengthening member 54 is preferably gripped resiliently between the walls of the 'U' shaped portion of the root of contact protrusion 40. Further, the portion of the roof wall 52 of the angular tubular member 50 that connects with the contact protrusion 40 has projecting pressing-down members 55 formed by bending so as to press down the strengthening plate 54 from the side as illustrated. By these means, the prevention of removal of the strengthening plate 54, and support for strengthening of the base portion of the contact protrusion 40 is effected.

The barrel member 30 of the male terminal fitting 20 has the usual insulation barrel 31 for fixing the insulated portion of the electric wire 70 by crimping, and a wire barrel 32 for fixing a core wire 71 of the electric wire 70 by crimping.

According to the above configuration, the contact protrusion 40 is formed by bending sheet metal, its root portion having the strengthening plate 54 inserted therein. As a result, the same strengthening is achieved as with internally located pins, and the contact protrusion 40 is thus stiffened against bending due to external forces. Of course, since the above configuration allows the male terminal fitting to be produced by bending a sheet metal, production cost is also kept low.

Moreover, and in particular, since in the present embodiment the angular tubular member 50 is formed at the base of the contact protrusion 40, and the strengthening plate 54 extends in a unified manner from the overlapping plate 53 of the angular tubular member 50, the strengthening of the base of the contact protrusion 40 is effected, with the additional advantage that the strengthening plate 54 can be formed by using a portion of the angular tubular member 50.

The present invention is not limited to the embodiments described above with the aid of diagrams. For example, the possibilities described below also lie within the technical range of the present invention. In addition, the present invention may be embodied in various other ways without deviating from the scope thereof.

In the above embodiment, the protecting cover 60 fits with the male terminal fitting 20, but this is not necessary and may be omitted. In such a case, it may equally be arranged so that a lance is formed on, for example, the angular tubular member 50; alternatively, a fitting hole may be formed into which a resin lance provided on the connector housing fits.

In the above embodiment, the entire contact protrusion 40 is groove-shaped; however, the configuration need not be limited to this, and it may equally be arranged so that the entirety or the anterior end is a different shape, as long as it is ensured that the base of the contact protrusion 40 has the strengthening member provided.

We claim:

1. A male terminal fitting formed entirely of sheet metal, the terminal having a body and a contact protrusion extending therefrom, a strengthening member protruding also from said body and extending along the root of said contact protrusion, said root having a generally 'U' shaped portion and said strengthening member extending within said 'U' shaped portion.

2. A terminal fitting according to claim 1 wherein said strengthening member is wholly within said 'U' shaped portion.

3. A terminal fitting according to claim 1 wherein said strengthening member is gripped resiliently between the walls of said 'U' shaped portion.

4. A terminal fitting according to claim 2 wherein said strengthening member (54) is gripped resiliently between the walls of said 'U' shaped portion.

5. A terminal fitting according to claim 1 wherein said U-shaped root includes a gap, and said fitting further includes a latching projection protruding from an edge face of said body and over said gap to maintain said strengthening member against said contact protrusion.

6. A terminal fitting according to claim 5 wherein said body (50) is tubular and has overlapping edge faces (52,53), the strengthening member (54) protruding from one edge face (53) and the latching projection (55) protruding from the other edge face (52).

7. A terminal fitting according to claim 6 wherein said body (50) is rectangular in cross section, the contact protrusion (40) protruding from three sides of said body, the strengthening member (54) protruding from a fourth side, and the latching projection (55) protruding from one edge of said-contact protrusion (40).

8. A terminal fitting according to claim 7 wherein the direction of projection of said latching projection (55) is perpendicular to the direction of projection of said strengthening member (54).

9. A terminal fitting according to claim 5 wherein said latching projection (55) extends across the open side of a 'U' shaped portion of said contact protrusion (40).

* * * * *